US009370204B2

(12) United States Patent
Kawata et al.

(10) Patent No.: US 9,370,204 B2
(45) Date of Patent: Jun. 21, 2016

(54) ORAL TOBACCO AND METHOD FOR MANUFACTURING THE SAME

(71) Applicant: JAPAN TOBACCO INC., Tokyo (JP)

(72) Inventors: Norio Kawata, Tokyo (JP); Manabu Takeuchi, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 0 days.

(21) Appl. No.: 14/039,486

(22) Filed: Sep. 27, 2013

(65) Prior Publication Data

US 2014/0020692 A1 Jan. 23, 2014

Related U.S. Application Data

(63) Continuation of application No. PCT/JP2012/057857, filed on Mar. 27, 2012.

(30) Foreign Application Priority Data

Mar. 30, 2011 (JP) ..... 2011-075532

(51) Int. Cl.

| | |
|---|---|
| ***A24B 15/00*** | (2006.01) |
| ***A24B 13/00*** | (2006.01) |
| | ***A24B 15/14*** |
| (2006.01) | ***A24B 3/00*** |
| (2006.01) | |

(52) U.S. Cl.

CPC . *A24B 13/00* (2013.01); *A24B 3/00* (2013.01); *A24B 15/14* (2013.01)

(58) Field of Classification Search

CPC ..... A24B 13/00; A24B 15/14; A24B 3/00
USPC ..... 131/352
See application file for complete search history.

(56) References Cited

U.S. PATENT DOCUMENTS 3,209,763 A 10/1965 Parmele et al.
5,169,481 A * 12/1992 Braunshteyn et al. ..... 156/378

(Continued)

FOREIGN PATENT DOCUMENTS

EP 1790240 A1 5/2007
JP 2009-538151 A 11/2009

(Continued)

OTHER PUBLICATIONS

Extended European Search Report, dated Apr. 9, 2015, for European Application No. 12764017.5.

*Primary Examiner* — Michael H Wilson
*Assistant Examiner* — Dionne Walls Mayes
(74) *Attorney, Agent, or Firm* — Birch, Stewart, Kolasch & Birch, LLP

(57) ABSTRACT

An oral tobacco raw material is easily handled during the manufacturing of oral tobacco, does not stain a packaging material when packaged as a pouch, and does not cause a feeling of a lump to a user and rapidly emits flavor when the user uses the pouch by placing it in the oral cavity. A method for manufacturing such an oral tobacco raw material, and a method for stably obtaining oral tobacco at low cost using the oral tobacco raw material are disclosed. A raw material chip for oral tobacco, includes a tobacco raw material composition including tobacco particles, water, and an additive, and a water-soluble edible film, the tobacco raw material composition and the water-soluble edible film being laminated, wherein outer surfaces of the raw material chip for oral tobacco are composed of a surface composed of the tobacco raw material composition, and a surface composed of the film.

8 Claims, 1 Drawing Sheet

(56) References Cited

U.S. PATENT DOCUMENTS

| | | | | |
|---|---|---|---|---|
| 7,946,296 | B2 | 5/2011 | Wrenn et al. | |
| 8,499,765 | B2 | 8/2013 | Fallon | |
| 2006/0191548 | A1* | 8/2006 | Strickland et al. | 131/347 |
| 2008/0149121 | A1 | 6/2008 | Wrenn et al. | |
| 2010/0200005 | A1 | 8/2010 | Fallon | |
| 2010/0275936 | A1* | 11/2010 | Bivehed | 131/119 |
| 2011/0220135 | A1 | 9/2011 | Wrenn et al. | |

FOREIGN PATENT DOCUMENTS

| | | | |
|---|---|---|---|
| JP | 2010-525800 | A | 7/2010 |
| JP | 2011-500021 | A | 1/2011 |
| JP | 2011-509090 | A | 3/2011 |
| WO | WO 98/08738 | A1 | 3/1998 |
| WO | WO 2005/115180 | A1 | 12/2005 |
| WO | WO 2006/065192 | A1 | 6/2006 |
| WO | WO 2007/138484 | A2 | 12/2007 |
| WO | WO 2008/062301 | A1 | 5/2008 |
| WO | WO 2008/062302 | A1 | 5/2008 |
| WO | WO 2008/103080 | A1 | 8/2008 |
| WO | WO 2008/114128 | A2 | 9/2008 |
| WO | WO 2008/114133 | A1 | 9/2008 |
| WO | WO 2009/025604 | A1 | 2/2009 |
| WO | WO 2009/048522 | A1 | 4/2009 |
| WO | WO 2009/048606 | A1 | 4/2009 |
| WO | WO 2009/087215 | A2 | 7/2009 |
| WO | WO 2009/098591 | A2 | 8/2009 |

* cited by examiner

ORAL TOBACCO AND METHOD FOR MANUFACTURING THE SAME

CROSS REFERENCE TO RELATED APPLICATIONS

This application is a Bypass Continuation of PCT International Application No. PCT/JP2012/057857 filed on Mar. 27, 2012, which claims priority under 35 U.S.C §119(a) to Patent Application No. 2011-075532 filed in Japan on Mar. 30, 2011, all of which are hereby expressly incorporated by reference into the present application.

BACKGROUND OF THE INVENTION

1. Field of the Invention

The present invention relates to oral tobacco, and particularly to raw material chips used for oral tobacco referred to as SNUS, and a method for manufacturing the raw material chips for the oral tobacco.

2. Description of the Related Art

Conventionally, as oral tobacco, which is smokeless tobacco, Snuff which is used by directly placing tobacco particles in the oral cavity to relish flavor has been known. But, in recent years, as oral tobacco in which the ease of handling for a user is improved, products referred to as SNUS have been widely known. In SNUS, a composition including tobacco particles, water, and the like is used as an oral tobacco raw material, and a pouch in which the composition is placed in a packaging material made of a nonwoven fabric or the like as a material is used as one unit. A plurality of pouches placed in a container are sold as a SNUS product.

The oral tobacco raw material including the composition including tobacco particles, water, and the like (hereinafter also simply referred to as an oral tobacco raw material), constituting the unit of SNUS, contains a relatively high content of water, considering the usability of the product for a user. Thus, the flowability of the oral tobacco raw material worsens, and a drawback is that the oral tobacco raw material is difficult to handle in the manufacturing process of SNUS.

In order to solve this, as an attempt to focus on methods for manufacturing oral tobacco, technical studies have been made largely in two directions so far.

The first direction is the study of mechanisms for stably delivering an oral tobacco raw material including a high content of water (for example, see International Publication No. WO2008/062301, International Publication No. WO2008/062302, and International Publication No. WO2009/025604). These Patent Literatures mainly disclose mechanisms for dropping an oral tobacco raw material into a void (measure) having a fixed volume and having, for example, a cylindrical shape and the like, and then delivering the oral tobacco raw material by compressed air or a tamping bar, and methods for using the same. International Publication No. WO2008/114133 and International Publication No. WO2008/114128 disclose mechanisms for sucking and blowing off an oral tobacco raw material on a drum for conveying an oral tobacco raw material, and methods for flushing the periphery of the mechanism portions.

On the other hand, the second direction is a study for improving the properties of an oral tobacco raw material including a high content of water itself. International Publication No. WO1998/008738 and International Publication No. WO2008/103080 disclose mechanisms for pressing and delivering an oral tobacco raw material by a compression drum or a compression belt.

International Publication No. WO2006/065192 discloses a method for forming an oral tobacco raw material into a sheet shape and punching it by a die.

In addition, another problem is that due to the high water content in the above oral tobacco raw material constituting the unit of SNUS, the water in the above oral tobacco raw material seeps through the nonwoven fabric, and thus, the appearance of the pouch is impaired.

Regarding this, Japanese Patent Laid-Open No. 2010-525800 discloses a method for manufacturing a pouch, including the step of cooling a composition containing tobacco particles and water to 0° C. or less before placing it in a packaging material and sealing it.

The systems described in International Publication No. WO2008/062301, International Publication No. WO2008/062302, and International Publication No. WO2009/025604 can be used for an oral tobacco raw material substantially including about 20 to 30% by weight of moisture. But, when they are applied to one including about 50% by weight of moisture, problems arise that when it is dropped into the void in the pouch manufacturing apparatus into which an oral tobacco raw material is put, its amount is variable, and after being delivered, the oral tobacco raw material easily clogs the downstream path, such as the conveyance tube.

Compared with the above methods, the methods described in International Publication No. WO2008/114133 and International Publication No. WO2008/114128 can also be used for an oral tobacco raw material including a high content of water. But, in the pouch manufacturing apparatus, the clogging of the sucking portion where the oral tobacco raw material is sucked, or entry into the drum may occur, and the structure of the apparatus is complicated, and the cost including that of maintenance is high.

The methods described in International Publication No. WO1998/008738 and International Publication No. WO2008/103080 aim to obtain a formed piece including the oral tobacco raw material in an amount corresponding to one pouch, and the ease of handling of the oral tobacco raw material is improved, but the pouch including the oral tobacco composition obtained by the methods gives an uncomfortable feeling as a lump of the formed piece to a SNUS user. In addition, in the method described in International Publication No. WO1998/008738, it is necessary to include a mechanism for compressing the oral tobacco raw material, and a mechanism for discharging the oral tobacco raw material, in the drum, and therefore, the apparatus is complicated and expensive. In addition, the number of components also necessarily increases, and therefore, the ease of cleaning, that is, cleanliness, may decrease. In the method described in International Publication No. WO2008/103080, the severing size of the formed piece is determined by the shape of the belt for conveying oral tobacco, and therefore, another problem is that when the size of the formed piece is changed, the above belt, the pulley for moving the belt, and the like must be changed.

In the method described in International Publication No. WO2006/065192, a polysaccharide or the like is mixed in the oral tobacco raw material so that it hardens easily, and the oral tobacco raw material is punched into a thickness of about 5 mm and a diameter of about 12 mm, and then dried and fixed. Therefore, the product gives an uncomfortable feeling as a lump of the formed piece to a user, like the formed pieces described in International Publication No. WO1998/008738 and International Publication No. WO2008/103080.

In the method described in Japanese Patent Laid-Open No. 2010-525800, the step of cooling the oral tobacco raw material before sealing it in a packaging material is necessary, and therefore, further one step is necessary in the manufacturing of the pouch.

From these, there has been a need for an oral tobacco raw material that is easily handled during the manufacturing of oral tobacco, does not stain a packaging material when packaged as a pouch, and does not cause a feeling of a lump and rapidly emits flavor when a user uses the pouch by placing it in the oral cavity, and there has been a need for a method for manufacturing such an oral tobacco raw material, and a method for stably obtaining oral tobacco at low cost using the oral tobacco raw material.

SUMMARY OF THE INVENTION

Accordingly, the present invention has been made in view of the above conventional circumstances, and it is a problem of the present invention to provide an oral tobacco raw material that is easily handled during the manufacturing of oral tobacco, does not stain a packaging material when packaged as a pouch, and does not cause a feeling of a lump to a user and rapidly emits flavor when the user uses the pouch by placing it in the oral cavity, a method for manufacturing such an oral tobacco raw material, and a method for stably obtaining oral tobacco at low cost using the oral tobacco raw material.

The present inventor has studied diligently and as a result found that the above problem can be solved by a raw material chip for oral tobacco, including a tobacco raw material composition including tobacco particles, water, and an additive, and a water-soluble edible film, the tobacco raw material composition and the water-soluble edible film being laminated, wherein outer surfaces of the raw material chip for oral tobacco are composed of a surface composed of the tobacco raw material composition, and a surface composed of the film, arriving at the present invention.

Specifically, the present invention is as follows.

[1] A raw material chip for oral tobacco, including a tobacco raw material composition including tobacco particles, water, and an additive, and a water-soluble edible film, the tobacco raw material composition and the water-soluble edible film being laminated, wherein outer surfaces of the raw material chip for oral tobacco are composed of a surface composed of the tobacco raw material composition, and a surface composed of the film.

[2] The raw material chip for oral tobacco according to [1], wherein an average thickness of a layer including the tobacco raw material composition is 1 to 5 mm.

[3] The raw material chip for oral tobacco according to [1] or [2], wherein a thickness of the water-soluble edible film is 1/20 to 1/100 of the average thickness of the layer including the tobacco raw material composition.

[4] The raw material chip for oral tobacco according to any one of [1] to [3], wherein the water-soluble edible film is a film including a film raw material including one or more selected from the group consisting of pullulan, guar gum, soybean, agar, cellulose, alginic acid, carrageenan, pectin, amylose, amylopectin, gelatin, and casein.

[5] The raw material chip for oral tobacco according to [4], wherein the film raw material further includes a perfume.

[6] The raw material chip for oral tobacco according to [5], wherein the perfume includes one or both of a fine powder of tobacco and an extract of tobacco.

[7] The raw material chip for oral tobacco according to any one of [1] to [6], having a quadrangular prism shape or a cylindrical shape.

[8] The raw material chip for oral tobacco according to any one of [1] to [7], including one or more selected from the group consisting of sodium carbonate, potassium carbonate, sodium polyphosphate, and sodium hydrogen carbonate, as the additive.

[9] A method for manufacturing raw material chips for oral tobacco, including a first step of compressing a tobacco raw material composition including tobacco particles, water, and an additive; a second step of laminating a film on the tobacco raw material composition compressed in the first step; and a third step of cutting or severing a laminate of the tobacco raw material composition and the film obtained in the second step.

[10] The manufacturing method according to [9], wherein a pressure of the compression in the first step is 2 MPa or more.

[11] A method for manufacturing oral tobacco, including a first step of compressing a tobacco raw material composition including tobacco particles, water, and an additive; a second step of laminating a film on the tobacco raw material composition compressed in the first step; a third step of cutting or severing a laminate of the tobacco raw material composition and the film obtained in the second step to obtain raw material chips for oral tobacco; and a fourth step of filling a packaging material with the raw material chips for oral tobacco obtained in the third step.

[12] The manufacturing method according to [11], wherein a pressure of the compression in the first step is 2 MPa or more.

The present invention can provide an oral tobacco raw material that is easily handled during the manufacturing of oral tobacco, does not stain a packaging material when packaged as a pouch, and does not cause a feeling of a lump to a user and rapidly emits flavor when the user uses the pouch by placing it in the oral cavity, a method for manufacturing such an oral tobacco raw material, and a method for stably obtaining oral tobacco at low cost using the oral tobacco raw material.

Further features of the present invention will become apparent from the following description of exemplary embodiments (with reference to the attached drawings).

DESCRIPTION OF THE EMBODIMENTS

The present invention will be described in detail below by giving embodiments, illustrations, and the like, but the present invention is not limited to the following embodiments, illustrations, and the like, and can be carried out by making optional changes without departing from the spirit of the present invention.

An embodiment of a raw material chip for oral tobacco according to the present invention (hereinafter also simply referred to as a raw material chip) will be described with reference to the drawings.

The raw material chip for oral tobacco according to the present invention is obtained by laminating a tobacco raw material composition 1 including tobacco particles, water, and an additive, and a water-soluble edible film 2, and the outer surfaces of the raw material chip for oral tobacco are composed of a surface composed of the above tobacco raw material composition, and a surface composed of the above water-soluble edible film (hereinafter also simply referred to as a film). By having such a configuration, when a user places a pouch in which the raw material chips are packaged, in the oral cavity, emission of flavor is good.

In addition, during the manufacturing of oral tobacco, because of the good flowability of its raw material chips, the handling is easy, and therefore, a complicated mechanism and the like are not required for an apparatus used in the manufacturing process of oral tobacco, the handling and cleaning of the apparatus and the like are easy, and trouble is less likely to occur.

Figure 1:
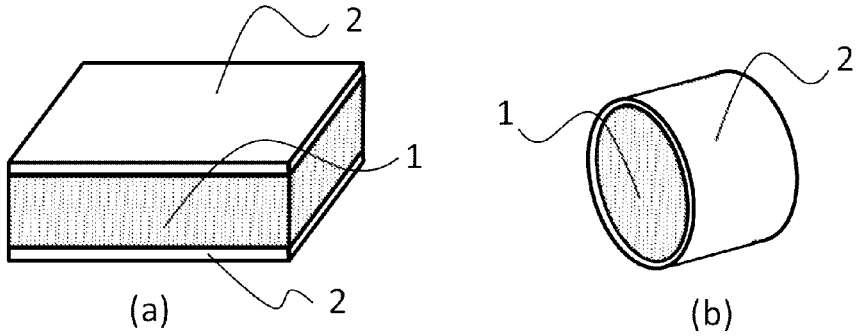
FIG. 1 is a schematic view illustrating the shape of a raw material chip for oral tobacco according to the present invention. (a) is one mode having a quadrangular prism shape. (b) is one mode having a cylindrical shape.

The cut or severed surfaces of the film are not included in the outer surfaces of the raw material chip in the invention of this application. Referring to FIG. 1, FIG. 1-(*a*) illustrates a mode in which, of the outer surfaces of the raw material chip, the side surfaces include surfaces including the tobacco raw material composition 1, and the upper surface and lower surface of the outer surfaces include the film 2. On the other hand, in the case of FIG. 1-(*b*), a mode is illustrated in which the outer surfaces of the raw material chip include the side surface of a cylinder including the film 2, and circular cross sections where the tobacco raw material composition 1 is exposed.

In the outer surfaces of the raw material chip of the present invention, the area of the surface composed of the tobacco raw material composition (surface where the tobacco raw material composition is exposed) is preferably in a proportion in the range of 0.1 to 0.8, particularly preferably in a proportion in the range of 0.2 to 0.5, with respect to the total outer area of the raw material chip. When the surface composed of the tobacco raw material composition is present in such a proportion, the flowability of the raw material chip, and the emission of the flavor of the tobacco during the use of the pouch are good. This proportion of area can be adjusted by changing the shape and size of the raw material chip in the manufacturing process of raw material chips described later.

Figure 2:
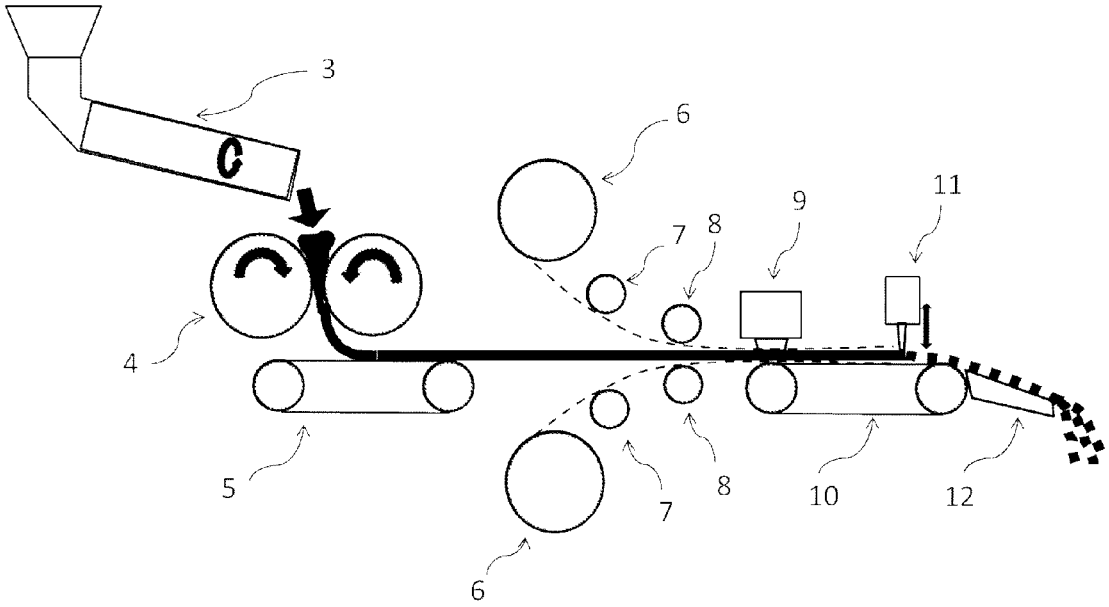
FIG. 2 is a schematic view illustrating one mode of the manufacturing process of raw material chips for oral tobacco according to the present invention.

When a compact of the tobacco raw material composition obtained by using compression rollers 4 as described in FIG. 2, as compression means, in a method for manufacturing raw material chips for oral tobacco described later is thin sheet-shaped, examples of the shape of the raw material chip include the following.

Various shapes can be obtained by appropriately changing cutting or severing means in the step of cutting or severing a laminate obtained by laminating a tobacco raw material composition and a film. For example, when means for making a longitudinal slit and a lateral slit is used as the above means for cutting the laminate, in one mode a quadrangular prism shape is obtained as illustrated in FIG. 1-(*a*).

In this mode, the surface of the film may be rectangular or square, or may have a shape such as a trapezoid.

In addition, when means such as a punching press is used as the above severing means, the shape of the obtained raw material chip can also be appropriately changed to a circle (also including a generally circular shape), a polygon, a shape surrounded by a curve and a straight line, or the like as seen from the film surface side, by punching the film surface into the desired shape.

On the other hand, in a case where a compact of the tobacco raw material composition obtained by using means such as an extruder, as the compression means, in the method for manufacturing raw material chips for oral tobacco described later is cylindrical or the like, by appropriately changing the angle of a slit cutting a laminate obtained by laminating a film on the tobacco raw material composition formed into a cylindrical shape, the laminate whose cross section is circular (also including generally circular) as in FIG. 1-(*b*) or elliptical can be obtained. As the shape of the obtained raw material chip, a cylindrical shape including one in which the bottom surface is not parallel is obtained.

When the shape of the discharge port of the extruder is appropriately changed, not only one whose cross section is circular, but also one whose cross section is polygonal, one whose cross section has a shape surrounded by a curve and a straight line, and the like are also obtained.

In the raw material chip, the average thickness of the layer including the tobacco raw material composition is preferably 1 to 5 mm. When the average thickness is less than 1 mm, it tends to be difficult to perform sheet forming with uniform thickness. When the average thickness is more than 5 mm, the compact is likely to crack or the like. Further, the average thickness is more preferably 1 to 3 mm. When the average thickness of the layer including the tobacco raw material composition is in this range, the strength of the raw material chip is preferably maintained, and in addition, the emission of flavor can be maintained well.

The average thickness of the layer including the tobacco raw material composition in the present invention refers to, when the layer including the tobacco raw material composition is thin sheet-shaped as in FIG. 1-(*a*), the average thickness of this layer including the tobacco raw material composition. On the other hand, when the layer including the tobacco raw material composition is cylindrical, and the layer (cross section) including the tobacco raw material composition is circular (generally circular), as in FIG. 1-(*b*), the average thickness of the layer including the tobacco raw material composition refers to the average value of the diameters of circle-equivalent diameters. When this is elliptical, the average thickness refers to the average value of minor axes. When the cross section is not circular or elliptical, the average value of the diameters of the projected area circle-equivalent diameters of cross sections is taken as the average thickness.

When the cross section is not perpendicular to the side surface, the thickness is determined based on a cross section when cut perpendicularly to the side surface of the cylinder. The average here refers to the arithmetic mean.

The size of the raw material chip is preferably 10 mm or less, more preferably 5 mm or less, in terms of its ease of handling. When the film surface is square or rectangular as in FIG. 1-(*a*), the size of the raw material chip in the present invention refers to the length of one side or long side of the film surface. When the raw material chip is cylindrical as in FIG. 1-(*b*), the size of the raw material chip refers to the maximum length between two cut surfaces of the raw material chip.

When the raw material chip is fabricated by the punching or the like of a laminate in which a film is laminated on a thin sheet-shaped tobacco raw material composition, the maximum length on the film surface is taken as the size of the raw material chip.

The raw material chip for oral tobacco according to the present invention is obtained by laminating a tobacco raw material composition including tobacco particles, water, and an additive, and a film, as described above.

The tobacco particles included in the above tobacco raw material composition are preferably 20 to 60% by weight, particularly preferably 30 to 50% by weight, based on the total amount of the tobacco raw material composition. The weight of the tobacco particles here is dry weight. But, during manufacturing, tobacco particles previously including moisture can be used when adjustment is performed so that the final water content in the composition satisfies the following range.

The water included in the tobacco raw material composition is preferably 20 to 60% by weight, particularly preferably 25 to 55% by weight, based on the total amount of the tobacco raw material composition.

The additive included in the tobacco raw material composition is preferably 0.5 to 5% by weight, particularly preferably 1 to 3% by weight, based on the total amount of the tobacco raw material composition. The additive included in the tobacco raw material composition is preferably 1 to 6% by weight, particularly preferably 2 to 5.5% by weight, based on the dry weight of the tobacco particles.

When the materials in the tobacco raw material composition are blended in the weight ranges as described above, the formability in laminating the tobacco raw material composition is excellent, and a good flavor can be given to a user when the user uses a pouch containing the fabricated raw material chips.

In addition, a perfume usually used in the art may be contained in the tobacco raw material composition. Its content is preferably 0.5 to 3% by weight based on the total amount of the tobacco raw material composition. The content is preferably 1 to 5% by weight based on the dry weight of the tobacco particles.

Further, a humectant usually used in the art may be contained in the tobacco raw material composition. Its content is preferably 3 to 10% by weight based on the total amount of the tobacco raw material composition. The content is preferably 5 to 15% by weight based on the dry weight of the tobacco particles.

The tobacco particles in the present invention include particles obtained by crushing laminas and stems, respectively, which are obtained by subjecting tobacco leaves to processing such as severing. As their particle sizes, the lamina is preferably one that has passed through a 1.2 mm mesh, more preferably one that has passed through a 1.0 mm mesh. On the other hand, in the stems, the particle size is preferably one that has passed through a 0.8 mm mesh, more preferably one that has passed through a 0.6 mm mesh.

When the particle sizes of the laminas and the stems included in the tobacco particles are as described above, the formability of the layer including the composition including the tobacco particles is further improved. Further, with particles having a small particle size, rather than particles having a large particle size, the fitness in a mouth is also good and the feeling of use is improved during the use of oral tobacco including the particles.

On the other hand, when the particle size of these is increased, the aggregation properties of the tobacco particles decrease, and therefore, after the layer including the composition including the tobacco particles is formed, it tends to become brittle.

The particles of laminas and the particles of stems included in the tobacco particles are preferably in the proportion of 1:0.5 to 1:2 when the weight of the laminas is 1, in terms of maintaining the balance of flavor well, and they are particularly preferably 1:0.8 to 1:1.2.

The type of tobacco is not particularly limited, but a burley, flue-cured, orient or domestic variety, or the like is preferably used. Blends of these particles are also preferably used.

The thickness of the film laminated on the tobacco raw material composition is preferably 1/20 to 1/100 of the average thickness of the layer including the tobacco raw material composition. As a specific thickness, 10 to 150 μm is preferred.

When the thickness of the film is less than 1/100 of the average thickness of the layer including the tobacco raw material composition, the solubility of the film during the use of oral tobacco is improved, and therefore, the discharge of the flavor of the tobacco and the like is good. But, a high degree of caution is required for the handling of the film and its raw material in a lamination step described later, and the strength of the laminate of the tobacco raw material composition and the film after lamination decreases, and therefore, collapse may occur easily during the lamination step.

On the other hand, when the thickness of the film is more than 1/20 of the average thickness of the layer including the tobacco raw material composition, the ease of unwinding the film in the lamination step described later, and the strength of the laminate of the tobacco raw material composition and the film after lamination are improved. But, the solubility of the film during the use of oral tobacco decreases, and therefore, the discharge of a tobacco flavor may be delayed, and an uncomfortable feeling in the mouth may be caused.

The thickness of the film is more preferably 1/25 to 1/75 of the average thickness of the layer including the tobacco raw material composition. As a specific thickness, 15 to 80 μm is more preferred. In such a range, the emission of flavor and the feeling of use during the use of oral tobacco, and the strength of the above laminate required in the manufacturing process can be made suitable.

The water-soluble edible film in the present invention does not become brittle or tear during the manufacturing of raw material chips for oral tobacco, and dissolves when a user places a pouch in which the raw material chips are contained in the mouth.

For the water-soluble edible films that can be used in the present invention, films including polysaccharide type pullulan, guar gum, soybean polysaccharide, agar, cellulose, alginic acid, carrageenan, pectin, and the like as raw materials, films including starch type amylose, amylopectin, and the like as raw materials, and films including raw materials including one or more selected from protein type gelatin, casein, and the like can be selected.

Among these, a polysaccharide type pullulan film and the like are pliable, and have good strength as a covering, and on the other hand, when a user places a pouch in which raw material chips using these are contained, in the mouth, solubility can be obtained.

In addition, a flavor component, such as a perfume, may be previously dispersed and mixed in the above water-soluble edible film. In this case, in addition to a general perfume, one or both of a fine powder of tobacco and an extract of tobacco, and the like can also be used. For example, in the case of using a film obtained by dispersing and mixing 1 to 2% by weight, based on the film, of a fine powder obtained by preparing processed tobacco so as to have a particle size of about 10 μm, during the early stage of the use of a pouch containing raw material chips using the film, a tobacco flavor is also discharged from the film, in addition to flavor discharged from the tobacco-exposed surfaces of the raw material chip (the layer including the tobacco raw material composition), and therefore, a user can taste a better flavor.

For the additive added to the tobacco raw material composition, food additives, such as sodium carbonate, potassium carbonate, sodium polyphosphate, sodium hydrogen carbonate, and mixtures thereof, can be used.

In addition, about 0.5 to 5% by weight of a binding agent based on the dry weight of the tobacco particles may be added to the tobacco particles in order to improve the shape retention properties of the layer including the tobacco raw material composition after forming.

When a large amount of the binding agent is added, the formability is improved, but the pliability decreases, and the oral tobacco tends to be less likely to fit in the oral cavity during use. For the binding agent, food thickening agents, such as cellulose, cellulose salts, alginate, or pectin, pullulan, carrageenan, guar gum, xanthan gum, and processed materials of these, or mixtures of any of these, can be used.

A method for manufacturing raw material chips for oral tobacco according to the present invention includes the first step of compressing a tobacco raw material composition including tobacco particles, water, and an additive; the second step of laminating a film on the tobacco raw material composition compressed in the first step; and the third step of cutting or severing the laminate of the tobacco raw material composition and the film obtained in the second step.

Here, for the tobacco raw material composition and the film used in the method for manufacturing raw material chips for oral tobacco according to the present invention, the same ones as used in the raw material chip for oral tobacco according to the present invention described above can be used.

Description will be given with reference to FIG. 2. In the first step, a tobacco raw material composition is supplied from a supply machine 3 (pipe feeder type supply machine) for supplying a tobacco raw material composition, to compression rollers 4, and compressed to form a thin sheet-shaped compact (layer). In the present invention, the concepts of rolling and extrusion are also included in "compression."

In the compression rollers, a pressure of about 2 MPa or more is preferably applied to the tobacco raw material composition. In the case of using a tobacco raw material composition including tobacco particles having a particle size of 1.2 mm or less and about 50% by weight of water based on the total amount of the composition, preferably used in the present invention, when the tobacco raw material composition is compressed at a pressure lower than this, the formability decreases, and the tobacco raw material composition becomes brittle. Therefore, the tobacco raw material composition is in the form of fragments (discontinuous) when fed to a film lamination step described later, and uniform products are less likely to be obtained. The upper limit of the pressure is not particularly limited, and can be appropriately set considering the formability of the layer of the tobacco raw material composition.

In addition, as a matter of course, also when the water content of the composition is lower than 50% by weight based on the total amount of the composition, the formability of the tobacco raw material composition tends to decrease, and therefore, in this case, adjustment for increasing compression pressure is necessary.

Although not illustrated, when raw material chips shaped as in FIG. 1-(*b*) are obtained, an extruder can also be used instead of the above compression rollers. Also in this case, the tobacco raw material composition can be extruded in a thin sheet shape, or other shapes including a cylindrical shape.

In the second step, a film is laminated on the tobacco raw material composition compressed in the first step. In the second step, film lamination can be performed by bonding films to the tobacco raw material composition by bonding rollers 8 using a mechanism as illustrated in FIG. 2. In such a mode, a mode in which the films are bonded to both of the upper surface and lower surface of the layer including the tobacco raw material composition, as illustrated in FIG. 2, is preferred. When the films are bonded to both of the upper surface and lower surface of the tobacco raw material composition, contamination due to seepage can be preferably prevented when a packaging material, such as a nonwoven fabric, is filled with the fabricated raw material chips.

The bonding rollers 8 may have a structure capable of controlling bonding pressure and temperature according to the properties of the compact of the tobacco raw material composition and the type and thickness of the films to be bonded. Further, humidity control vessels and temperature control vessels may be installed in the paths of the films to previously control the flexibility and stickiness of the films. It is also possible to, after bonding, provide light heating to the extent that no shrinkage or peeling occurs in the film surface, to improve separability from a feed belt 10, and the like.

On the other hand, when a compact (layer) of the tobacco raw material composition is formed using an extruder or the like without using compression rollers in the first step, lamination can also be performed by coaxially extruding a film in a solution state on the outer periphery of the compact of the tobacco raw material composition, and drying it to the extent that the film solution fixes quickly.

Although not particularly illustrated, scrapers, guides, and the like can be installed in the compression rollers 4 and the bonding rollers 8 to improve the peelability and continuity of the materials. In addition, in order to more suitably control productivity and quality according to the materials, structures capable of controlling the temperature of the rollers may be provided.

The laminate obtained by laminating the tobacco raw material composition and the film in the second step is cut or severed in the third step. In this third step (also referred to as a slitting step), longitudinal slits by circular rotary blades or the like followed by lateral slits by a severing blade reciprocating up and down are made, as illustrated in FIG. 1. But, slits can also be made by replacing the blades by a cylindrical rotary blade in which a plurality of long blades are disposed on the circumference. Further, slits can also be made by laterally reciprocating a plurality of circular rotary blades. In these blades, by adjusting the gaps between the blades, the size of the raw material chip can be made the desired size.

Further, each slit can take a shape other than a straight line, for example, a wave, and the lateral slits can be arranged orthogonal or non-orthogonal to the longitudinal slits.

In addition, raw material chips can also be obtained by severing the laminate by punching it into the desired shape by punching means, rather than slitting.

In addition, in order to improve the separability of the material after the cutting or severing, a scraping mechanism, such as a scraper, can also be provided.

In the case of the compact obtained by forming the film on the outer periphery of the tobacco raw material composition formed using an extruder or the like, the compact can be cut into raw material chips by a rotary blade or a reciprocating blade.

In the above steps, simple configurations having no complicated and fine movable mechanisms or the like can be selected, and the ease of cleaning, that is, the maintenance of cleanliness, is also easy.

A method for manufacturing oral tobacco according to the present invention includes the first step of compressing a tobacco raw material composition including tobacco particles, water, and an additive; the second step of laminating a film on the tobacco raw material composition compressed in the first step; the third step of cutting or severing the laminate of the tobacco raw material composition and the film obtained in the second step to obtain raw material chips for oral tobacco; and the fourth step of filling a packaging material with the raw material chips for oral tobacco obtained in the third step.

The above first step, second step, and third step are similar to those of the method for manufacturing raw material chips for oral tobacco.

In addition, for the tobacco raw material composition and the film used in the method for manufacturing oral tobacco according to the present invention, the same ones as used in the raw material chip for oral tobacco according to the present invention described above can be used.

The above fourth step is the step of filling a packaging material with the raw material chips, for example, via a pipe feeder type automatic weighing machine, though not illustrated. At this time, the amount of the raw material chips supplied can be adjusted to adjust the amount of the raw material chips filling a pouch. After the packaging material is filled with the raw material chips, it is sealed by means such as heat sealing to obtain a pouch.

The packaging material can be used without particular limitation, and cellulose type nonwoven fabrics and the like are preferably used.

Examples

The present invention will be more specifically described by an Example, but the present invention is not limited to the description of the following Example unless departing from the spirit thereof.

The present invention will be more specifically described below by an Example, but the present invention is not limited to the description of the following Example unless departing from the spirit thereof.

As illustrated in FIG. 1 as one example, for the manufacturing of raw material chips for oral tobacco, first, as the step of forming a tobacco raw material composition including tobacco particles into a layer, a first step for forming a tobacco raw material composition into a thin sheet shape (compression step) can be used. Next, a second step for laminating films on the front and back of the compact of the tobacco raw material composition (lamination step), and then a third step for cutting or severing the laminate in which the films are laminated (slitting step) can be used. In addition, in order to manufacture a pouch that is oral tobacco, a fourth step for filling a pouch with the cut or severed laminate (raw material chips) obtained in the third step can be used. An Example using these steps will be described.

A blend obtained by crushing laminas of flue-cured tobacco and laminas of burley tobacco so as to each have a particle size of 1.2 mm or less and blending them in the weight proportion of 1:2, and a blend obtained by crushing stems of flue-cured tobacco and stems of burley tobacco so as to each have a particle size of 0.8 mm or less and blending them in the weight proportion of 1:2 were mixed in the weight proportion of 1:1 to obtain a mixture 1.

Then, a mixture 2 was obtained by the following method. Water, 5% by weight of sodium chloride based on the dry weight of the mixture 1, and 4% by weight of sodium carbonate based on the dry weight of the mixture 1, as an additive, were added to the mixture 1, with the water content adjusted at about 33% by weight based on the total amount of the mixture 2.

Then, a tobacco raw material composition was obtained by the following method. Water, 12% by weight of a humectant based on the dry weight of the mixture 1, 1% by weight of guar gum based on the dry weight of the mixture 1, as a binding agent, and 3% by weight of a perfume based on the dry weight of the mixture 1 were added to the mixture 2 obtained by heating in an autoclave at 100° C. for 3 hours or more and cooling to room temperature, with the moisture adjusted at about 50% by weight based on the total amount of the tobacco raw material composition, to obtain the tobacco raw material composition. In this tobacco raw material composition, 40% by weight of tobacco particles (the mixture 1) are contained based on the total amount of the tobacco raw material composition, and 1.6% by weight of the additive is contained based on the total amount of the tobacco raw material composition.

This tobacco raw material composition was supplied onto two compression rollers by a pipe feeder type supply machine, and compression-formed so that the average thickness of the tobacco raw material composition was about 1.1 mm, while the pressing pressure between the rollers was controlled to about 4 MPa.

Then, water-soluble edible films including pullulan as a raw material, having a thickness (25 μm) that is 1/44 of the thickness of the layer including the tobacco raw material composition, were laminated on the front surface and back surface of the compact of the tobacco raw material composition by bonding to obtain a laminate having a basis weight of about 1,200 g/m$^2$.

Then, this laminate was slit into a length of about 5 mm and a width of about 5 mm to obtain raw material chips for oral tobacco having substantially square pullulan surfaces and having a pliable touch. The ratio of the area of the surfaces including the tobacco raw material composition to the total outer area of the raw material chip at this time was about 0.3.

Then, in order to examine differences in tackiness and flowability for the obtained raw material chips, about 300 g of the obtained raw material chips and about 300 g of the tobacco raw material composition not formed into raw material chips were placed in beakers, and allowed to stand for about 30 minutes, and then, the beakers were tilted, and the discharge state was observed. The tobacco raw material composition was difficult to uniformly discharge, and an aggregated state was seen. But, the raw material chips flowed out relatively uniformly, and no aggregation of the raw material chips was seen.

Next, the obtained raw material chips were supplied to a pouch packaging machine (using a nonwoven fabric as a packaging material) via a pipe feeder type automatic weighing machine to obtain SNUS pouches filled with about 0.6 g of the raw material chips per pouch. No contamination, such as stains, was seen in the appearance of the pouches.

Next, the obtained pouch was used by placing it in the oral cavity. There was no special uncomfortable feeling, such as a feeling of a lump, and as the films dissolved, good seepage of a tobacco flavor was obtained.

When a certain amount of the raw material chips for oral tobacco according to the present invention are placed in a packaging material including a nonwoven fabric or the like to fabricate a SNUS product as a pouch, and a user uses it, flavor is quickly discharged from the tobacco-exposed surfaces of the raw material chips, and the SNUS product fits in a mouth and the films dissolve, and the raw material chips further discharge flavor while collapsing.

During the use of the pouch, finally, the films dissolve completely, and the raw material chips are integrated. Therefore, compared with the tobacco raw material composition in an amount corresponding to one pouch, processed into a block shape, and the like, the pouch causes no uncomfortable feeling, such as a feeling of a lump, fits easily in the oral cavity, and is also excellent in the emission of flavor and a feeling of use.

In addition, when the packaging size of the pouch or the amount of the raw material chips filling the pouch is changed in the manufacturing of oral tobacco, only the amount of the raw material chips supplied should be changed, and it is not necessary to adjust the forming size of the forming drum or change the forming belt. In addition, the apparatus is not complicated, mechanical trouble is less likely to occur, and the cleaning is also easy.

SYMBOL FULL DESCRIPTION

1 tobacco raw material composition
2 film
3 tobacco raw material composition supply machine
4 compression roller
5 feed belt
6 raw film
7 guide roller
8 bonding roller
9 slitter (longitudinal)
10 blade receiver/feed belt
11 slitter (lateral)
12 vibration feeder While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The present application is a continuation application of International Application No. PCT/JP2012/057857, filed Mar. 27, 2012, which claims priority to Japanese Patent Application No. 2011-075532, filed Mar. 30, 2011. The contents of these applications are incorporated herein by reference in their entirety.

What is claimed is:

1. A SNUS pouch filled with raw material chips for oral tobacco, comprising a tobacco raw material composition layer comprising tobacco particles, water, and an additive, and a water-soluble edible film, the tobacco raw material composition layer and the water-soluble edible film being laminated, wherein outer surfaces of the raw material chip for oral tobacco are composed of at least one surface composed of the tobacco raw material composition, and at least one surface composed of the film, an average thickness of the layer comprising the tobacco raw material composition is 1 to 5 mm, and a thickness of the water-soluble edible film is 1/20 to 1/100 of the average thickness of the layer comprising the tobacco raw material composition, wherein the water-soluble edible film disposed on the tobacco raw material composition layer is completely dissolved in the oral cavity, and the strength of the raw material chips and the emission of flavor from the raw material chips is effectively maintained.

2. The SNUS pouch filled with raw material chips for oral tobacco according to claim 1, wherein the water-soluble edible film is a film comprising a film raw material comprising one or more selected from the group consisting of pullulan, guar gum, soybean, agar, cellulose, alginic acid, carrageenan, pectin, amylose, amylopectin, gelatin, and casein.

3. The SNUS pouch filled with raw material chips for oral tobacco according to claim 2, wherein the film raw material further comprises a perfume.

4. The SNUS pouch filled with raw material chips for oral tobacco according to claim 1, wherein the chip has a quadrangular prism shape or a cylindrical shape.

5. The SNUS pouch filled with raw material chips for oral tobacco according to claim 1, wherein the chip comprises one or more selected from the group consisting of sodium carbonate, potassium carbonate, sodium polyphosphate, and sodium hydrogen carbonate, as the additive.

6. The SNUS pouch of claim 1, wherein, in the outer surfaces of the raw material chip, the area of the surface where the tobacco raw material composition is exposed is proportionally in a range of 0.1 to 0.8 with respect to the total outer area of the raw material chip.

7. The SNUS pouch of claim 1 wherein the average thickness of the layer comprising the tobacco raw material composition is 1 to 3 mm.

8. The SNUS pouch of claim 1 wherein the water included in the tobacco raw material composition is 20% by weight, based on the total amount of the tobacco raw material composition.

* * * * *